US005763736A

United States Patent [19]

Daume

[11] Patent Number: 5,763,736

[45] Date of Patent: Jun. 9, 1998

[54] METHOD FOR THE DISPOSAL OF EXPLOSIVE MATERIAL

[75] Inventor: Eduard Daume, Richterswil, Switzerland

[73] Assignee: Oerlikon Contraves Pyrotec AG, Zurich, Switzerland

[21] Appl. No.: 834,833

[22] Filed: Apr. 10, 1997

[30] Foreign Application Priority Data

Feb. 13, 1997 [CH] Switzerland ..... 19970309/97

[51] Int. Cl.[6] ..... A62D 3/00

[52] U.S. Cl. ..... 588/203; 149/124

[58] Field of Search ..... 588/202, 203; 149/124

[56] References Cited

U.S. PATENT DOCUMENTS

| | | | |
|---|---|---|---|
| 4,229,182 | 10/1980 | Frosch et al. | 23/293 R |
| 4,231,822 | 11/1980 | Roth | 149/109.6 |
| 5,516,971 | 5/1996 | Hurley | 588/203 |
| 5,523,517 | 6/1996 | Cannizzo et al. | 588/203 |

FOREIGN PATENT DOCUMENTS 4036787 5/1992 Germany .

4115435 8/1992 Germany .

OTHER PUBLICATIONS

Chemical Abstracts, abstract no. 324452, vol. 124, No. 24, Jun. 10, 1996.

Chemical Abstracts, abstract no. 81161, vol. 105, No. 10, Sep. 8, 1986.

Chemical Abstracts, abstract no. 203970, vol. 93, No. 21, Nov. 24, 1980.

Basil T. Fedoroff et al., "Encyclopedia of Explosives and Related Items", part 2700, vol. 3, pp. D26, D30, 1966.

"Hazards of Chemical Rockets and Propellants", CPIA Publication 394, vol. 1, pp. E1–E3, Sep. 1984.

Dr. T. Urbanski, "Chemie Und Technologie Der Explosivstoffe", vol. 11, 1963.

*Primary Examiner*—Ngoclan Mai

*Attorney, Agent, or Firm*—Browdy and Neimark

[57] ABSTRACT

A method for the decomposition of explosive materials into water-soluble products is offered, which can be disposed of in a thermal or biochemical way, which requires only very short reaction times because of the addition of polar, aliphatic, non-saponifiable compounds to a strongly basic, preferably aqueous reaction medium and under temperature control by means of the metered addition of the explosive materials.

20 Claims, No Drawings

METHOD FOR THE DISPOSAL OF EXPLOSIVE MATERIAL

FIELD OF THE INVENTION

The instant invention relates to a method for the safe chemical decomposition of explosive materials on an industrial scale into water soluble reaction products which can be disposed of either thermally, biochemically or in a biochemical and thermal combination.

BACKGROUND OF THE INVENTION

In this connection, explosive materials are understood to be propellants capable of detonation and explosives from the class of nitric acid esters, such as nitrocellulose, nitramines, such as hexogen, nitro compounds, such as trinitrotoluene, as well as mixtures of these explosive materials, which have been completely separated by dismantling from the remaining portions of the munitions to be disposed of.

The necessity of disposing of explosive materials always occurs when there is no storage capacity for outdated munitions, or when the chemical stability of less stable explosive materials, such as nitrocellulose, in overaged munitions represents a safety risk. Known methods for disposing of explosive materials, which formerly were used often, are open burning and blasting. These processes are no longer permitted for reasons of safety technology and/or ecological reasons, or they can only be performed for compelling reasons under time-restricted special permits.

In case of open burning, the explosive material is loosely spread in low piles, sometimes also in mixtures with stabilizing liquid or solid fuels, such as oils, solvents or sawdust and burned in the open at burning sites arranged for this. In the course of this, toxic organic residues can get into the ground water. Furthermore, the gaseous reaction products have an intolerably high $NO_x$ concentration by today's viewpoint. There is the danger of a detonation when using excessive amounts of explosive materials piled up too high. Furthermore, when using a burning site in too short intervals of time, it is possible for the glowing embers hidden in the solid residue to lead to premature ignition when fresh material is added. Serious accidents are known to have occurred as a result of such events.

During blasting, the detonation taking place under high pressure and temperature results in gaseous reaction products with tolerable amounts of toxic reaction products, such as carbon monoxide and $NO_x$. However, the great efforts required for cordoning off large areas for the blasting site, the adverse effects of the noise and the danger of accidents are disadvantageous.

Closed burning is the disposal method for explosive materials presently most often used in countries of the West. This term is understood to apply to the burning of explosive materials in furnaces specially developed for this, which are equipped with a device for the removal of $NO_x$. These installations meet the present-day ecological requirements. The high cost of investment and the danger of a detonation which cannot be completely removed are considered to be disadvantageous for economical operations.

Further disposal methods for explosive materials, known in principle and partially proposed, but not yet executed on an industrial scale, have multiple stages. First, in an initial stage, the explosive materials are chemically decomposed into non-toxic, water-soluble products.

The further disposal stages include the possibilities for biochemical decomposition of these products or their safe burning in a garbage incineration installation. Biochemical decomposition can take place directly by using the neutralized aqueous solution as a liquid fertilizer, or indirectly by means of producing sewage sludge, which can also be used as a fertilizer, but can also be burned. For the conversion into sewage sludge the aqueous solution can be supplied to a sewage treatment plant of sufficient capacity. However, the direct use as a liquid fertilizer is useful from an economical point of view, since this is a useful product which can be made by the simplest means.

Information regarding multi-stage processes for the disposal of explosive materials can be found in the volumes of the "Encyclopedia of Explosives and Related Items", Picatinny Arsenal, Dover, N.J., USA, listed below: a process for the chemical decomposition of nitrocellulose is described in PATR 2700, 1966, Vol. 3 (D30), wherein 100 lbs of the explosive material are chemically decomposed by the batchwise addition to a hot, stirred solution at 70° C. made of 50 lbs NaOH and 460 lbs water. A laboratory process is disclosed in the same chapter, wherein the chemical decomposition is performed with a 15% aqueous $Na_2S$ solution in a water bath. It is recommended in chapter C26 to use the inorganic nitrates obtained from partially water-soluble explosive materials, such as ammonal and black powder, by aqueous extraction, i.e. products, which are also created during the chemical decomposition of the non-water-soluble explosive materials, as fertilizer.

Possibilities for the disposal of treated explosive material waste by means of biological decomposition and/or combustion are listed in "Hazards of Chemical Rockets and Propellants", Volume 1, CPIA Publication 394, September 1984.

The following reaction products are recited by T. Urbanski in "Chemie und Technologie der Explosivstoffe" [Chemistry and Technology of Explosive Materials], Volume 11, Leipzig, 1963, for nitrocellulose which has been treated with a caustic soda solution or a caustic potash solution, nitrogen, carbon dioxide, alkali nitrate and nitrite, alkali salts of formic, oxalic, hydroxy acids and not further identifiable keto- and aldehyde acids and sugar. Malic acid and dihydrobutyric acid are listed as hydroxy acids. In accordance with this information, the created water-soluble solids can be disposed of without problems biochemically as well as thermally because of their chemical structure, provided the bases which were used in excess during the chemical decomposition are neutralized by inorganic or organic acids, such as phosphoric, sulfuric, acetic or formic acid.

Finally, a decomposition process by reduction with expensive organic compounds is protected by U.S. Letters Pat. No. 4,231,822, which requires uneconomically long reaction times.

The described methods for the chemical decomposition of explosive materials, in particular nitrocellulose, are either intended for small amounts or have the character of basic attempts to make determinations in principle, where the length of reaction is of no consequence. They are unsuitable for industrial use for the following reasons: as a rule, the explosive materials are present as rough crystals or, in the case of polymeric compounds, as granules, the described decomposition reactions with bases and/or reduction agents take a strongly exothermal course. In the course of adding the explosive materials to the aqueous solution of the reactive materials the mass conversion at the recited low temperatures in the range of 70° C. is small because of the small particle surfaces. Therefore, initially only a weak temperature increase occurs. When adding too large amounts of explosive materials in connection with large mixes, this can lead in a short while to an exponential and therefore dangerous temperature rise because of a heat accumulation, which is no longer controllable even when strongly cooled. A further disadvantage of the method resides in that after one half of the entire amount of explosive material has been converted, the reaction slows down so much that the temperature must be continuously increased by heating. This effect makes a safe process control more difficult and inevitably increases the reaction length.

OBJECT AND SUMMARY OF THE INVENTION

Accordingly, it is the object of the invention to disclose a safe rapid and therefore economical method for the decomposition of explosive materials, which is suitable for industrial use and which can be coupled with the thermal and/or biochemical disposal of the decomposition products.

This object is attained by means of the method for the decomposition of explosive materials into water-soluble, biochemically or thermally disposable products, having the characterizing features of claim 1.

The object is particularly attained by means of a method, in which solid explosive materials are

- metered into a liquid reaction medium containing at least one inorganic reduction agent and/or at least a strong base, and in addition 10 to 30 weight-% of a polar, aliphatic non-saponifiable solvent,
- converted in an exothermal decomposition process into soluble compounds while being intermixed therein and while the temperature is such that it preferably maintains the reaction medium at the boiling point, wherein the solvent is being reflux-cooled,
- whereupon the reaction medium is selectively neutralized by means of at least one inorganic acid,
- and the neutralized material is at least partially isolated.
- Thereafter, the disposal can be completed in a thermal or biochemical manner.

In this case the reaction medium is preferably aqueous and has a pH value of approximately 14 during the entire decomposition reaction.

The components, bases, reduction medium, water and solvent preferably form a reactive dispersion because of their strong alkalinity, in which the solvent portion is advantageously kept constant until the end of the decomposition reaction.

The control reaction and temperature is made possible by the continuously or discontinuously added amounts of explosive materials in such a way that the reaction enthalpy of the explosive material corresponds to the evaporation enthalpy of the boiling solvent or its azeotrope, which is returned to the process by means of reflux cooling. In this connection an intensive intermixing, preferably by stirring, is of advantage.

Since the reaction is strongly exothermal, the cooling effect of the boiling solvent can be advantageously aided, at least some of the time, by exterior cooling of the reaction medium.

In this case, the term solvent is understood to include polar, aliphatic, non-saponifiable compounds which boil at a lower point than the aqueous portion of the reactive medium. A dissolving effect on the explosive materials is not necessary.

Preferred solvents are alcohols, such as methanol, ethanol and isopropanol, wherein ethanol is particularly preferred, as well as ketones, such as acetone, methylethyl ketone and diethyl ketone.

Besides the mentioned regulating effect on the temperature control in the reaction medium. Effects of the solvents lie in a great acceleration of the reaction speed of the decomposition of the explosive materials which, in the example of nitrocellulose, can increase to four to six times, as well as in a very advantageous damping of foam generation in the preferably aqueous reaction medium.

Aqueous solutions of NaOH and KOH are preferably employed as strong bases, wherein their effective concentration must be decided on the basis of economical considerations. A soda type of at least 20 weight-% and a potash type of at least 27 weight-% are particularly preferred for use. The upper concentration limit is determined by the viscosity of the aqueous solutions and the solubility parameters of the added solvents and lies at approximately 40 weight-%.

In connection with the already mentioned example of nitrocellulose, an experimental value of 0.75 kg NaOH per kg of nitrocellulose has shown itself to be advantageous for complete decomposition.

The concentration of the possibly also used inorganic reduction agent, which preferably are NaHS and $Na_2S$, lies between 5 and 30 weight-%, depending on the concentration of the bases.

The neutralization of the strongly alkaline reaction medium which, in the stirred state preferably is present as a dispersion, which consists of water, decomposition products, excess bases and reduction media as well as solvents, wherein these components in the dissolved form are distributed at different ratios in the dispersion phases, is advantageously matched to the disposal of the completely decomposed explosive materials. As a rule, neutralization is not required for solutions which are intended to be decomposed biologically in sewage treatment plants.

For use as fertilizer, neutralization is preferably performed by means of phosphoric acid. Next to this, nitric acid and sulfuric acid are preferred.

As a further step in the method of the invention, at least partial isolation of the "neutralized product" is advantageous, also depending on the further use. The at least partial distillation of the solvent is particularly advantageous, which in this way can be used again while, for example, it is even disruptive when used as fertilizer or in the course of thermal disposal by incineration.

In connection with biological disposal and further use of the "neutralized product" as fertilizer, it is advantageous to meet the respective requirement profile, which is specially profiled for the content of nitrogen, phosphorus and potassium as NPK value, by adding or supplementing with selected plant nutrients.

The method in accordance with the invention therefore is to be made cost-effective in an advantageous manner in that

- the reaction medium is heated to a large degree to the reaction temperature by means of the solution heat of the alkalihydroxides,
- the decomposition of the explosive materials takes place without the addition of outside energy at the boiling temperature of the solvent or its azeotrope, preferably ethanol,
- the length of time required for the conversion is drastically lowered by the use of cost-effective solvents,
- costs can be recovered by using the decomposition products are fertilizers.

Besides this, particularly special advantages lie in the safe and environmentally friendly course of the method and its non-toxic end products.

The advantages of the invention will be explained in more detail by means of the following two examples.

DETAILED DESCRIPTION

EXAMPLE 1 (COMPARISON EXAMPLE)

Not the method of the invention, without the addition of ethanol, for comparison.

In a wall-heated reactor, 7.30 kg of "nitrocellulose" were added in portions to 15.6 kg of an NaOH solution of a concentration of 30% and set to an isothermal temperature of 90±2° C. in the course of 195 minutes while stirring. Under these conditions the temperature of the contents of the reactor varied in a range between 88° to 108° C. with a standard deviation of 5° C. around an average value of 101° C. Following the weakening of the reaction, which could be recognized by the temperature drop at the feed side, the temperature of the heating cycle was raised from 97° to 103° C. Almost all remaining particles of the explosive material had been converted after 150 minutes. During this phase the temperature of the contents of the vessel dropped from 100° to 970° C.

The most important method data are:

"Nitrocellulose"—propellant powder for artillery munitions, broken into lengths of 60 mm from strips of the dimension of 495×11×1 mm.

Specific amount of solid NaOH used: 0.75 kg/kg "nitrocellulose".

Aspect and properties of the reaction solution: low viscosity, dark, pH 14.

Conversion, determined by decanting the reaction solution and isolating the remaining particles: 99.8%.

Reaction time: 5.8 hours.

EXAMPLE 2 (METHOD OF THE INVENTION)

174 g water and 37.4 g ethanol were placed into a 500 $cm^3$ sulfonation flask with reflux cooling. After adding 74.7 g of solid NaOH within 5 minutes while stirring, the temperature of the solution rose to the highest value of 71° C. as the result of the solution enthalpy. At this temperature the addition of 100 g of "nitrocellulose" in portions took place. After 10 minutes boiling took place at a temperature of the solution of 77° C. Within 34 minutes during constant boiling the entire amount of "nitrocellulose" was added. The highest temperature of 80° C. was reached after 35 minutes. After a total of 54 minutes the temperature dropped to 70° C. under natural cooling.

The most important method data here are:

"Nitrocellulose"—propellant powder for artillery munitions, broken into lengths of 20 mm from strips of the dimension of 495×11×1 mm.

Specific amount of solid NaOH used: 0.75 kg/kg "nitrocellulose".

Aspect and properties of the reaction solution: low viscosity, dark, pH 14.

Conversion, determined by decanting the reaction solution and isolating the remaining particles: >99.9%.

Reaction time: 0.90 hours.

What is claimed is:

1. A method for the decomposition of explosive materials into water-soluble, biochemically or thermally disposable products, with the steps of:

a. adding solid explosive materials to a liquid reaction medium containing at least one inorganic reduction agent and/or at least one strong base, b. exothermal decomposition of the explosive material into soluble compounds, while being intermixed and with the temperature controlled, c. selective neutralization of the reaction medium by the addition of at least one inorganic acid, d. at least partial isolation of the "neutralization product", and e. disposal of the "neutralization product", characterized in that the reaction medium is aqueous and additionally contains 10 to 30 weight-% of a polar, aliphatic, non-saponifiable solvent, whose evaporation enthaipy is maintained in balance with the reaction enthalpy of the explosive material by means of the metering speed with which the explosive material is added to the reaction medium.

2. The method in accordance with claim 1, characterized in that decomposition is performed in the boiling reaction medium and with the reflux of the solvent or its azeotrope.

3. The method in accordance with claim 2, characterized in that the reaction medium has a pH value of approximately 14 during the decomposition.

4. The method in accordance with claim 3, characterized in that the solvent is a compound which boils at a lower temperature than the aqueous portion of the reaction medium, selected from the group of methanol, ethanol, propanol, i-propanol, acetone, methylethyl ketone and diethyl ketone.

5. The method in accordance with claim 4, characterized in that the strong base is selected from the group of NaOH and KOH.

6. The method in accordance with claim 5, characterized in that the reduction agent is selected from the group of $Na_2S$ and NaHS.

7. The method in accordance with claim 6, characterized in that the acids are selected from the group of sulfuric acid, phosphoric acid and nitric acid.

8. The method in accordance with claim 7, characterized in that cooling is performed at least part of the time for the temperature control of the reaction medium.

9. The method in accordance with claim 8, characterized in that intermixing of the reaction medium is performed by stirring.

10. The method in accordance with claim 9, characterized in that the low-boiling solvent is at least partially distilled off for the at least partial isolation of the neutralization product.

11. The method in accordance with claim 10, characterized in that the disposal takes place by the thermal method by incineration or by the biological method by sewage treatment processes or as a fertilizer.

12. The method in accordance with claim 11, characterized in that the disposal as a fertilizer takes place after the addition of complementary plant nutrients.

13. The method in accordance with claim 1, characterized in that the reaction has a pH value of approximately 14 during the decomposition.

14. The method in accordance with claim 1, characterized in that the solvent is a compound which boils at a lower temperature than the aqueous portion of the reaction medium, selected from the group of methanol, ethanol, propanol, i-propanol, acetone, methylenthyl ketone and diethyl ketone.

15. The method in accordance with claim 1, characterized in that the strong base is selected from the group of NaOH and KOH.

16. The method in accordance with claim 1, characterized in that the reduction agent is selected from the group of $Na_2S$ and NAHS.

17. The method in accordance with claim 1, characterized in that the acids are selected from the group of sulfuric acid, phosphoric acid and nitric acid.

18. The method in accordance with claim 1, characterized in that cooling is performed at least part of the time for the temperature control of the reaction medium.

19. The method in accordance with claim 1, characterized in that the low-boiling solvent is at least partially distilled off for the at least partial isolation of the neutralization product.

20. The method in accordance with claim 1, characterized in that the disposal takes place by the thermal method by incineration or by the biological method by sewage treatment processes or as a fertilizer.

* * * * *